US010295245B2

(12) United States Patent
Yao et al.

(10) Patent No.: US 10,295,245 B2
(45) Date of Patent: May 21, 2019

(54) REFRIGERATION APPARATUS

(71) Applicants: HEFEI HUALING CO., LTD., Hefei (CN); MIDEA GROUP CO., LTD., Foshan (CN)

(72) Inventors: Jun Yao, Hefei (CN); Dongxian Liu, Hefei (CN)

(73) Assignees: HEFEI HUALING CO., LTD., Hefei (CN); MIDEA GROUP CO., LTD., Foshan (CN)

( * ) Notice: Subject to any disclaimer, the term of this patent is extended or adjusted under 35 U.S.C. 154(b) by 0 days.

(21) Appl. No.: 15/765,273

(22) PCT Filed: Apr. 29, 2016

(86) PCT No.: PCT/CN2016/080699
§ 371 (c)(1),
(2) Date: Apr. 2, 2018

(87) PCT Pub. No.: WO2017/181438
PCT Pub. Date: Oct. 26, 2017

(65) Prior Publication Data

US 2019/0049171 A1 Feb. 14, 2019

(30) Foreign Application Priority Data

Apr. 20, 2016 (CN) ..... 2016 1 0255435

(51) Int. Cl.
*F25D 23/02* (2006.01)
*F25D 25/02* (2006.01)

(52) U.S. Cl.
CPC ..... *F25D 23/028* (2013.01); *F25D 23/02* (2013.01); *F25D 25/025* (2013.01); *F25D 2323/02* (2013.01); *F25D 2400/22* (2013.01)

(58) Field of Classification Search
CPC .. F25D 23/028; F25D 23/025; F25D 2323/02; F25D 2400/22; A47B 88/44; A47B 88/443; A47B 88/447
See application file for complete search history.

(56) References Cited

U.S. PATENT DOCUMENTS 9,939,014 B1 * 4/2018 Chiu ..... F16O 29/10
2003/0173882 A1 9/2003 Koons
(Continued)

FOREIGN PATENT DOCUMENTS

CN 2789689 Y 6/2006
CN 101596045 A 12/2009
(Continued)

OTHER PUBLICATIONS

European Search Report dated Jan. 21, 2019 in the corresponding EP application (application No. 16899025.7).

*Primary Examiner* — Daniel J Rohrhoff
(74) *Attorney, Agent, or Firm* — Kilpatrick Townsend & Stockton, LLP

(57) ABSTRACT

A refrigeration device, including a cabinet, a door body, a drawer, a first snap assembly, and a second snap assembly. The door body is provided to the cabinet in a drawable manner; the drawer is detachably provided to the door body, the first snap assembly is adapted to limit the door body at a first position where the door body can be fixed to the cabinet, the second snap assembly is adapted to limit the door body at a second position where the door body can be fixed to the cabinet, during the process that the door body is pulled out of the cabinet, the door body passes through the first position and the second position in sequence, when the first snap assembly fails, the drawer is adapted to be taken out of the door body, and when the second snap assembly fails, the door body is adapted to be separated from the cabinet.

10 Claims, 7 Drawing Sheets

(56) References Cited

U.S. PATENT DOCUMENTS

| | | | | |
|---|---|---|---|---|
| 2006/0266020 | A1* | 11/2006 | Okamoto | F02D 37/02 60/284 |
| 2006/0266070 | A1 | 11/2006 | Ertz et al. | |
| 2016/0178274 | A1* | 6/2016 | Shin | F25D 25/025 312/408 |
| 2017/0254585 | A1* | 9/2017 | Dickerson | F25D 25/025 |

FOREIGN PATENT DOCUMENTS

| | | | |
|---|---|---|---|
| CN | 202126134 | U | 1/2012 |
| CN | 104172760 | A | 12/2014 |
| EP | 2600087 | A1 | 6/2013 |

* cited by examiner

REFRIGERATION APPARATUS

CROSS-REFERENCE TO RELATED APPLICATION

This application is a national phase entry under 35 USC § 371 of International Application PCT/CN2016/080699, filed Apr. 29, 2016, which claims priority to and benefits of Chinese Patent Applications Serial No. 201610255435.X, filed with the State Intellectual Property Office of P. R. China on Apr. 20, 2016, the entire contents of which are incorporated herein by reference.

FIELD

The present disclosure relates to a technical field of refrigeration equipment, and more particularly to a refrigeration apparatus.

BACKGROUND

A freezer door body of a refrigeration apparatus belongs to a drawer type with a slide rail, and due to cleaning requirements, the following three conditions need to be satisfied: normal opening or closure of the door body, removal of a drawer, and removal of the entire door body.

In the related art, the slide rail of the freezer door body of the refrigeration apparatus has only one snap for fixation, and the snap is located inside the refrigeration apparatus, which is inconvenient for operation; furthermore, after the snap fails, the entire door body may be brought out easily when the door body is pulled out to remove the drawer, which causes damages; moreover, since the snap is located inside the refrigeration apparatus, operations cannot be visualized, but only depend on feelings, which is very difficult and hence has room for improvement.

SUMMARY

The present disclosure aims to solve at least one of the problems existing in the related art to at least some extent. Therefore, the present disclosure provides a refrigeration apparatus with high safety and usage convenience.

The refrigeration apparatus according to embodiments of the present disclosure includes: a cabinet; a door body provided to the cabinet in a drawable manner; a drawer detachably provided to the door body; a first snap assembly adapted to limit the door body at a first position where the door body is fixed to the cabinet; and a second snap assembly adapted to limit the door body at a second position where the door body is fixed to the cabinet. The door body passes through the first position and the second position sequentially in a process of pulling the door body out of the cabinet, the drawer is adapted to be pulled out of the door body when the first snap assembly fails, and the door body is adapted to be separated from the cabinet when the second snap assembly fails.

For the refrigeration apparatus according to embodiments of the present disclosure, two stages of snap assemblies are provided on a path of relative movement between the door body and the cabinet, three states, in which the door body is opened or closed normally, the drawer is taken out of the door body easily, and the door body is separated from the cabinet easily, can be realized when the requirement of taking or placing goods with different volumes is also satisfied. Furthermore, when the first snap assembly is damaged or fails, the second snap assembly can still function to prevent the entire door body from being brought out when the door body is pulled out to remove the drawer, thereby avoiding damage to personnel and the refrigeration apparatus. The refrigeration apparatus according to embodiments of the present disclosure is convenient to use and has high safety.

In some embodiments of the present disclosure, the refrigeration apparatus further includes: a slide rail assembly including a slide rail support fixed to an inner wall of the cabinet; and a slide rail movably connected with the slide rail support and fixed to the door body.

In some embodiments of the present disclosure, the first snap assembly includes two first snapping members that are fitted with each other, one of the two first snapping members is fixed to the slide rail support, and the other one thereof is fixed to a surface of the slide rail facing the slide rail support.

In some embodiments of the present disclosure, the one of the two first snapping members is configured as a hook, while the other one thereof is configured as a protrusion.

In some embodiments of the present disclosure, an end of the slide rail support facing the door body is provided with a recess recessed backwards, a bottom of the recess is provided with a protruding part that extends towards the door body and is spaced apart from two side walls of the recess, and the protruding part and one side wall of the recess form the hook.

In some embodiments of the present disclosure, the hook is provided with a pressing part that is adapted to be pressed.

In some embodiments of the present disclosure, the second snap assembly includes two second snapping members that are fitted with each other, one of the two second snapping members is fixed to the slide rail support, and the other one thereof is fixed to a surface of the slide rail facing the slide rail support.

In some embodiments of the present disclosure, the one of the two second snapping members is configured as a snap, while the other one thereof is configured as a slot.

In some embodiments of the present disclosure, the snap is provided to a side surface of the slide rail support opposite to the inner wall of the cabinet, and the snap is configured as a cantilever having an end connected with the slide rail support.

In some embodiments of the present disclosure, a part of the first snap assembly adapted to be operated is provided at an edge of the cabinet adjacent to the door body, and is exposed when the door body is pulled out of the cabinet.

Figure 1:
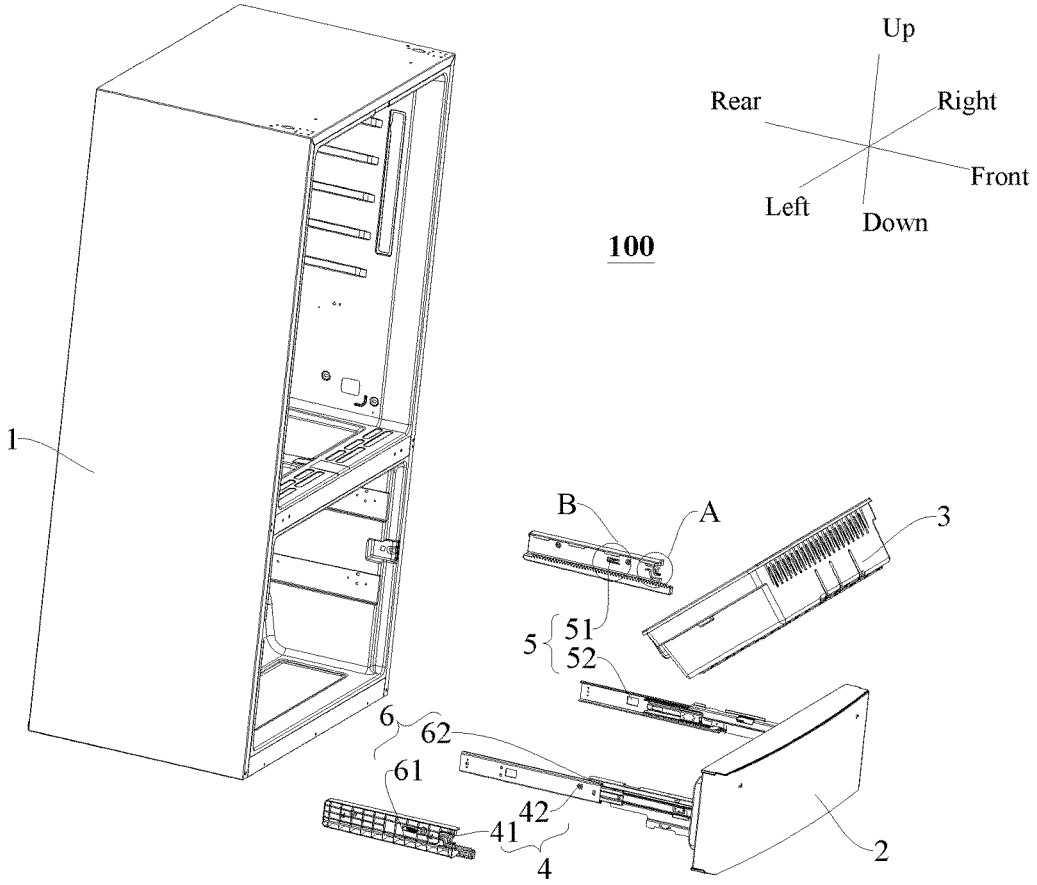
FIG. 1 is an exploded view of a refrigeration apparatus according to an embodiment of the present disclosure.

Reference Numerals:

refrigeration apparatus 100, cabinet 1, door body 2, drawer 3, first snap assembly 4, hook 41, pressing part 411, lightening hole 412, guide surface 413, protrusion 42, second snap assembly 5, snap 51, slot 52, slide rail assembly 6, slide rail support 61, recess 611, protruding part 612, side wall 613, slide rail 62.

DETAILED DESCRIPTION

Embodiments of the present disclosure will be described below in detail, and examples of the embodiments will be illustrated in the accompanying drawings. The embodiments described with reference to the drawings are explanatory and intended to interpret the present disclosure, and should not be constructed to limit the present disclosure.

A refrigeration apparatus 100 can refrigerate and store goods that need to be stored at a low temperature. In one embodiment, the refrigeration apparatus 100 can be a refrigerator, a freezer, a refrigeration cabinet and the like.

The refrigeration apparatus 100 according to embodiments of the present disclosure will be described below with reference to FIGS. 1-12. As illustrated in FIGS. 1-12, the refrigeration apparatus 100 according to embodiments of the present disclosure includes a cabinet 1, a door body 2, a drawer 3, a first snap assembly 4 and a second snap assembly 5.

The door body 2 is provided to the cabinet 1 in a drawable manner, and the drawer 3 is detachably provided to the door body 2. When the drawer 3 is required to store goods, the drawer 3 can be mounted to the door body 2; when the drawer 3 needs to be cleaned, the drawer 3 can be detached from the door body 2; when the door body 2 or an interior of the cabinet 1 needs to be repaired, the door body 2 can be drawn out of the cabinet 1, that is, the door body 2 can be separated from the cabinet 1.

The first snap assembly 4 is configured to limit the door body 2 at a first position where the door body 2 may be fixed to the cabinet 1, that is, when the door body 2 is located in the first position, the first snap assembly 4 functions, and the door body 2 and the cabinet 1 are fixed by the first snap assembly 4.

The second snap assembly 5 is configured to limit the door body 2 at a second position where the door body 2 may be fixed to the cabinet 1, that is, when the door body 2 is located in the second position, the second snap assembly 5 functions, and the door body 2 and the cabinet 1 are fixed by the second snap assembly 5.

In a process of pulling the door body 2 out of the cabinet 1, the door body 2 passes through the first position and the second position sequentially; when the first snap assembly 4 fails, the drawer 3 is adapted to be taken out of the door body 2; when the second snap assembly 5 fails, the door body 2 is adapted to be separated from the cabinet 1.

The process of pulling the door body 2 out of the cabinet 1 is presented as follows.

Figure 4:
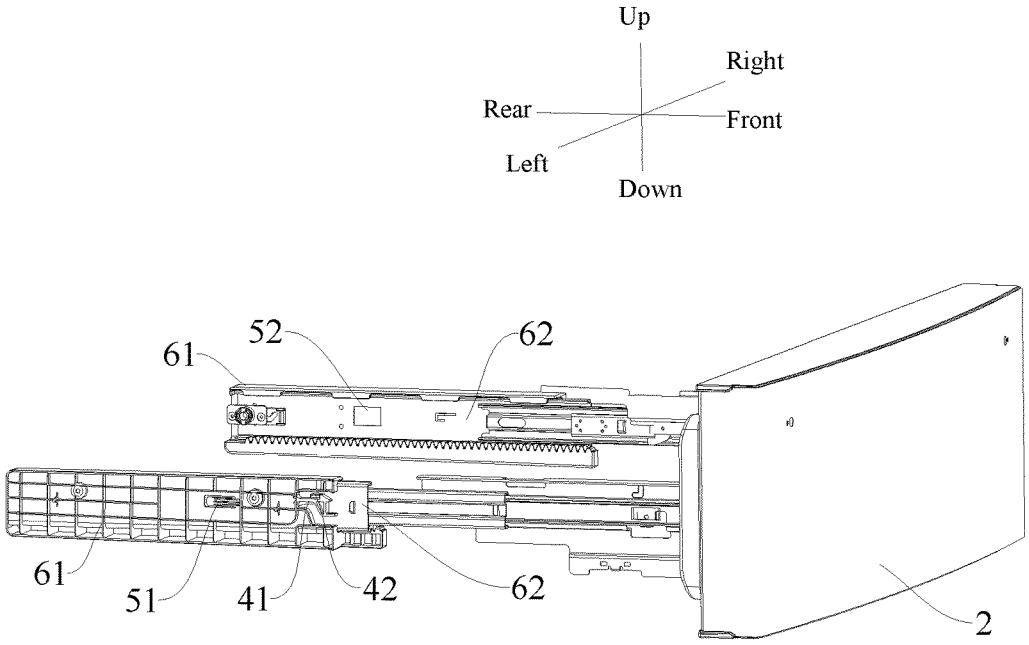
FIG. 4 is a schematic view of a door body of a refrigeration apparatus according to an embodiment of the present disclosure from a viewing angle, in which the door body is located in a first position.
Figure 5:
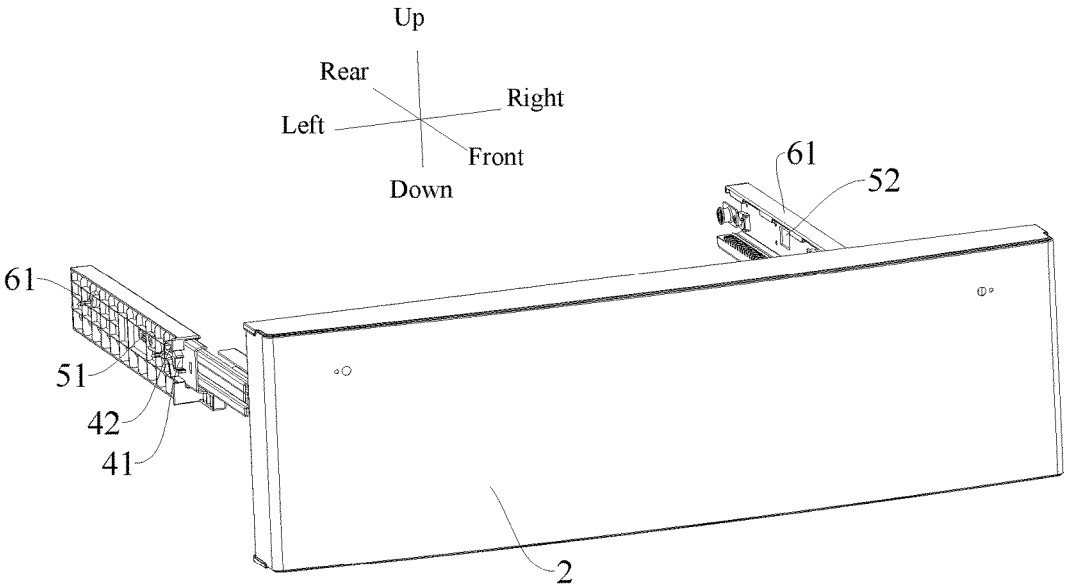
FIG. 5 is a schematic view of a door body of a refrigeration apparatus according to an embodiment of the present disclosure from another viewing angle, in which the door body is located in a first position.

When it is necessary to open the door body 2 to take or place the goods in the drawer 3, the door body 2 is pulled back; as illustrated in FIGS. 4 and 5, when the door body 2 is pulled to the first position, the first snap assembly 4 functions to fix the door body 2 and the cabinet 1.

Figure 6:
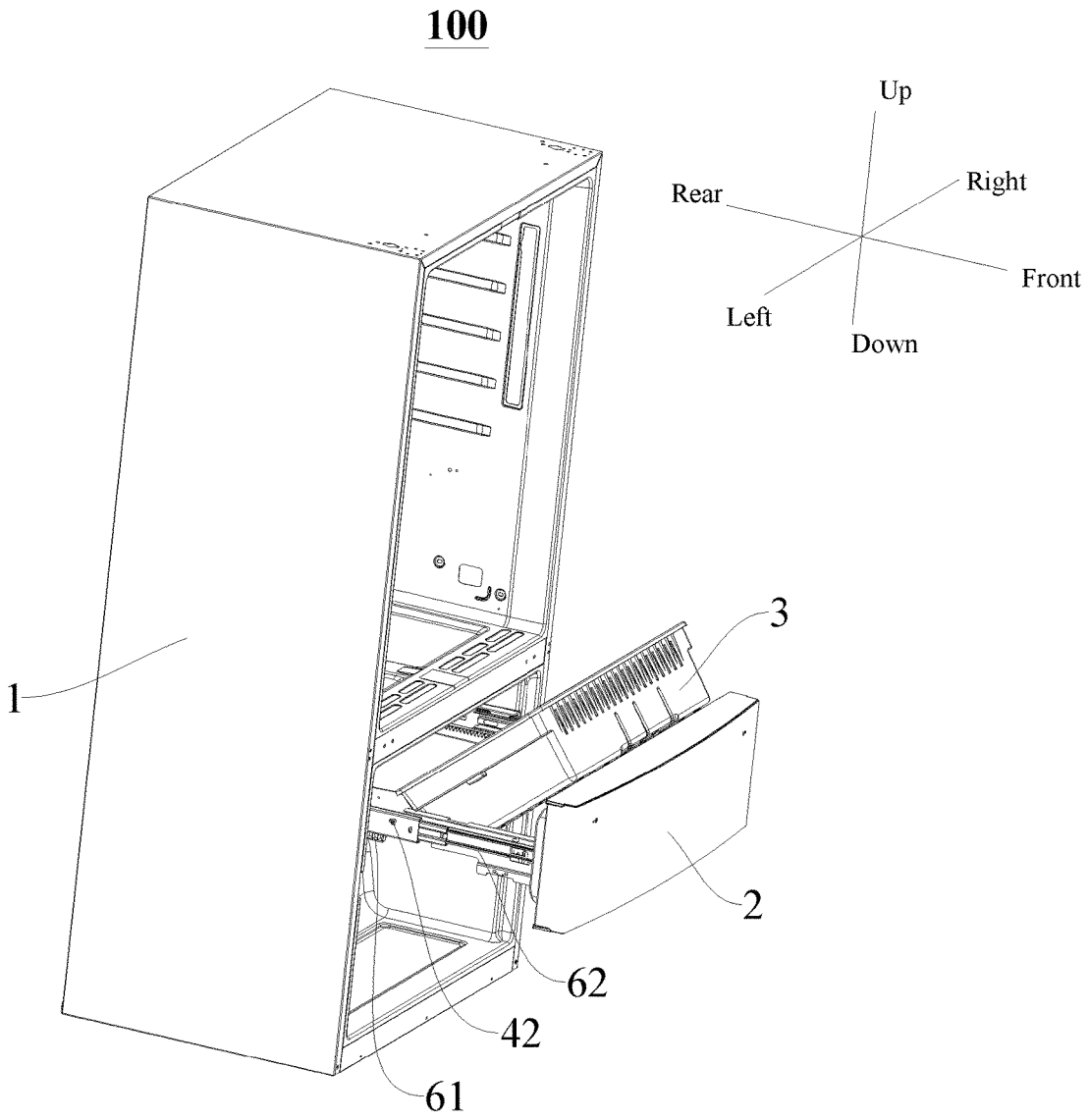
FIG. 6 is a schematic view of a refrigeration apparatus according to an embodiment of the present disclosure, in which a door body is located between a first position and a second position.

When the drawer 3 needs to be taken out, the door body 2 is first pulled to the first position, and then the first snap assembly 4 is operated to be disabled, i.e. the door body 2 is again movable relative to the cabinet 1; hence, the door body 2 is pulled again to a desired position, and as illustrated in FIG. 6, the drawer 3 can be rotatably taken out, which facilitates cleaning.

Figure 7:
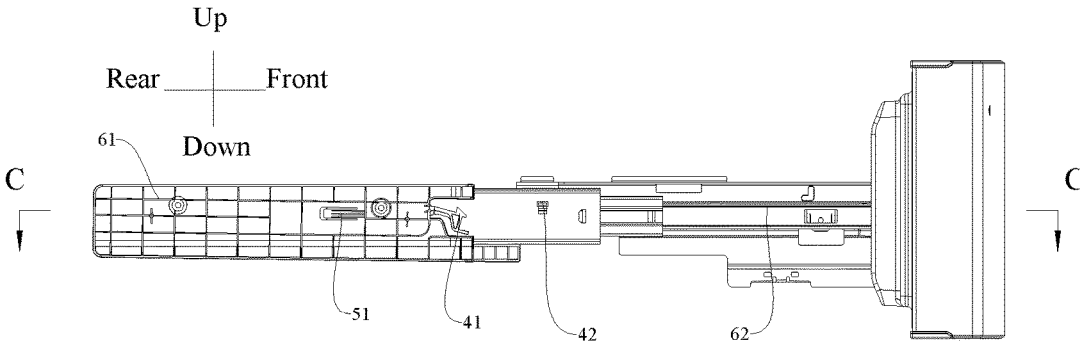
FIG. 7 is a schematic view of a door body of a refrigeration apparatus according to an embodiment of the present disclosure, in which the door body is located in a second position.
Figure 8:
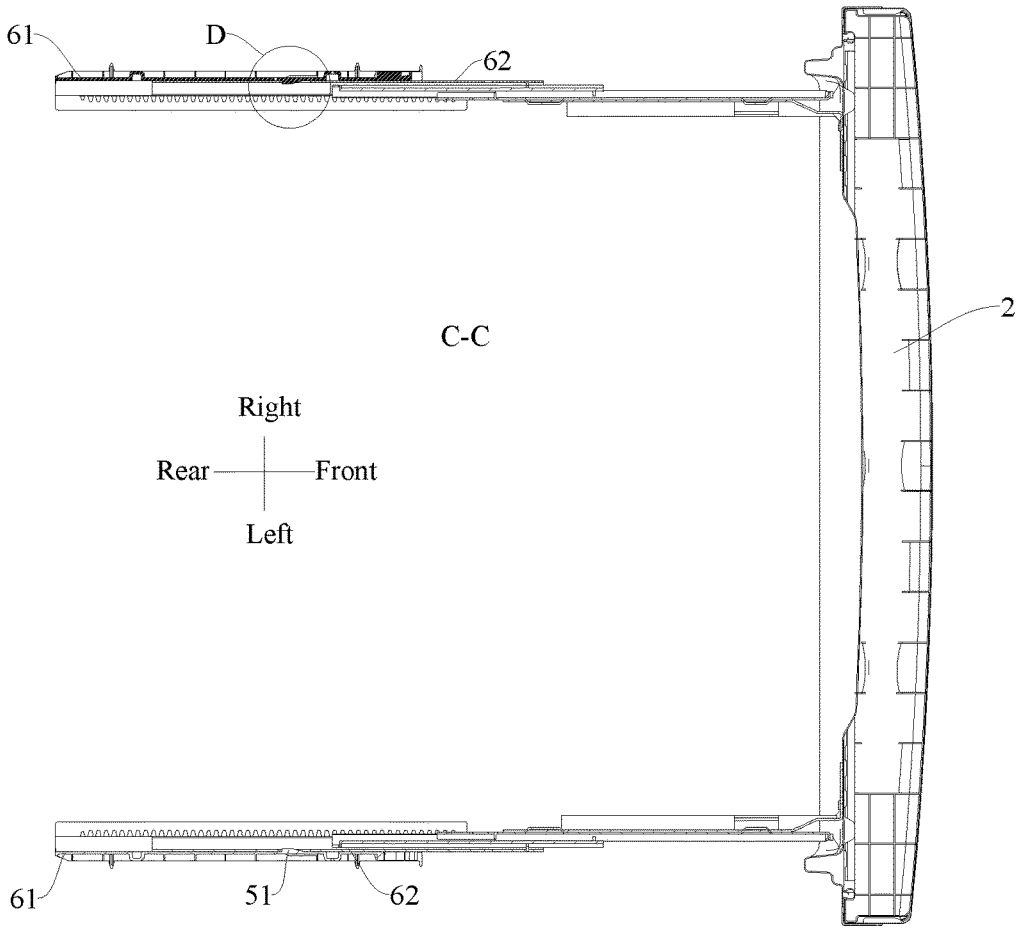
FIG. 8 is a sectional view of FIG. 7 along a C-C direction.
Figure 10:
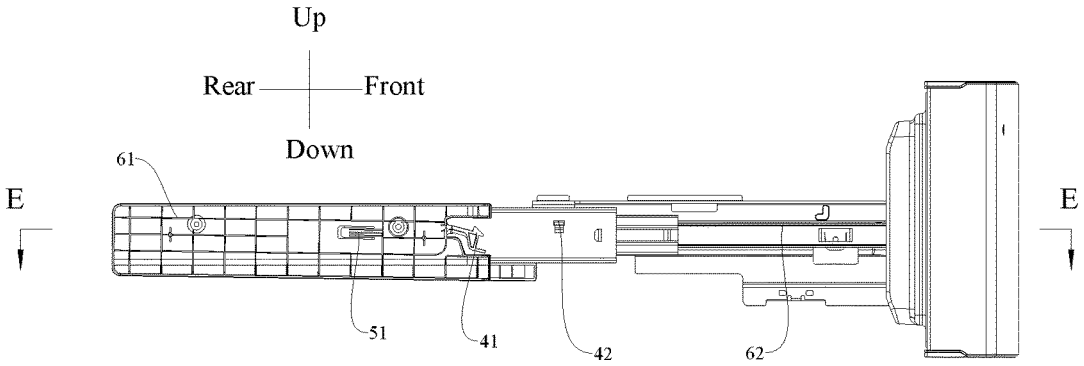
FIG. 10 is a schematic view of a door body of a refrigeration apparatus according to an embodiment of the present disclosure, in which the door body is located beyond a second position.

When the door body 2 needs to be separated from the cabinet 1, the door body 2 is first pulled to the first position illustrated in FIGS. 4 and 5; then the first snap assembly 4 is operated to be disabled, so as to continue pulling the door body 2 until it reaches the second position illustrated in FIGS. 7 and 8; the second snap assembly 5 is then operated to be disabled, i.e. the door body 2 is again movable relative to the cabinet 1; as illustrated in FIG. 10, the door body 2 is pulled again to be separated from the cabinet 1, thereby facilitating repair on the door body 2 or the interior of the cabinet 1.

It is known from the above description that the first snap assembly 4 and the second snap assembly 5 both have to be disabled if it is intended to separate the door body 2 wholly from the cabinet 1.

It could be understood that the door body 2 is capable of being fixed to the cabinet 1 in two positions; when the door body 2 is fixed in the first position, a distance between the door body 2 and the cabinet 1 is relatively small, which satisfies a requirement of taking or placing part of goods, but when the door body 2 is fixed in the second position, the distance between the door body 2 and the cabinet 1 is enlarged, which can satisfies a requirement of taking or placing some goods with relatively large volume.

A process of closing the door body 2 is opposite the above process of pulling the door body 2 out of the cabinet 1, and hence will not be elaborated herein.

For the refrigeration apparatus 100 according to embodiments of the present disclosure, two stages of snap assemblies are provided on a path of relative movement between the door body 2 and the cabinet 1, three states, in which the door body 2 is opened or closed normally, the drawer 3 is taken out of the door body 2 easily, and the door body 2 is separated from the cabinet 1 easily, can be realized when the requirement of taking or placing goods with different volumes is also satisfied. Furthermore, when the first snap assembly 4 is damaged or fails, the second snap assembly 5 can still function to prevent the entire door body 2 from being brought out when the door body 2 is pulled out to remove the drawer 3, thereby avoiding damage to personnel and the refrigeration apparatus 100. The refrigeration apparatus according to embodiments of the present disclosure is convenient to use and has high safety.

Some specific embodiments of the refrigeration apparatus 100 according to the present disclosure will be described with reference to FIGS. 1-12. As illustrated in FIGS. 1-12, the refrigeration apparatus 100 includes the cabinet 1, the door body 2, the drawer 3, the first snap assembly 4, the second snap assembly 5 and a slide rail assembly 6.

In one embodiment, the refrigeration apparatus 100 is configured as a refrigerator, and the door body 2 is configured as a door body 2 of a freezer door of the refrigerator.

As illustrated in FIG. 1, the door body 2 is provided to the cabinet 1 in a drawable manner by means of the slide rail assembly 6. The drawer 3 is detachably provided to the door body 2.

The slide rail assembly 6 includes a slide rail support 61 and a slide rail 62, and the slide rail support 61 is fixed to an inner wall of the cabinet 1. The slide rail 62 is fixed to the door body 2 and movably connected with the slide rail support 61, that is, the slide rail 62 is movable relative to the slide rail support 61, and the slide rail support 61 is configured to support the slide rail 62.The slide rail 62 can be a multistage slide rail, such that the stroke can be adjusted. By providing the slide rail assembly 6 between the cabinet 1 and the door body 2, the door body 2 can be pulled relative to the cabinet 1 more smoothly and can be supported on the cabinet 1 more stably.

In one embodiment, the slide rail support 61 can be fixed to the cabinet 1 by a threaded connection, such that the installation of the slide rail assembly 61 is more convenient. Certainly, the slide rail support 61 can be integrally formed with the cabinet 1.

In a further embodiment, the slide rail support 61 can be a plastic part, and the slide rail 62 can be a metal slide rail. Such a material setting makes it easy to manufacture and low in production cost.

It could be understood that the slide rail support 61 and the slide rail 62 each include two portions symmetrically arranged in a width direction of the refrigeration apparatus 100.

The first snap assembly 4 is configured to limit the door body 2 at the first position where the door body 2 may be fixed to the cabinet 1, and a part of the first snap assembly 4 adapted to be operated is provided at an edge of the cabinet 1 adjacent to the door body 2. "The part of the first snap assembly 4 adapted to be operated" refers to a part that can be operated to disable the first snap assembly 4 so as to make the door body 2 movable relative to the cabinet 1 and that will be exposed when the door body 2 is pulled out of the cabinet 1, that is, when the door body 2 is pulled out, the door body 2 is spaced apart from the cabinet 1, and at this time, the part for operating and disabling the first snap assembly 4 is exposed. Thus, the operation of the first snap assembly 4 is visualized to facilitate the operation and reduce the probability of damage to components and parts.

Figure 2:
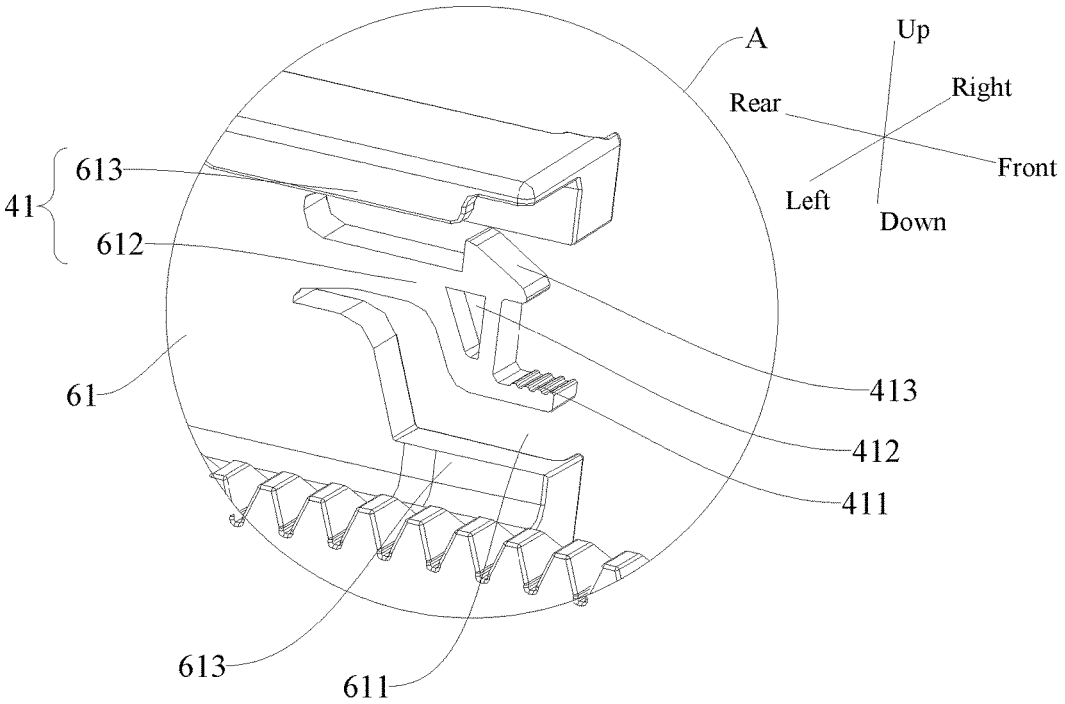
FIG. 2 is an enlarged view of part A in FIG. 1.

As illustrated in FIGS. 1 and 2, the first snap assembly 4 includes two first snapping members that are fitted with each other, and one of the two first snapping members is fixed to the slide rail support 61 while the other one thereof is fixed to a surface of the slide rail 62 facing the slide rail support 61. That is, the slide rail support 61 is fixed to the inner wall of the cabinet 1, the slide rail 62 is located at an inner side of the slide rail support 61, and the two first snapping members are arranged opposite to each other and fitted with each other. When the first snap assembly 4 functions, the two first snapping members are fitted to fix the door body 2 and the cabinet 1, i.e. fixing the door body 2 at the first position; when the first snap assembly 4 fails, the two first snapping members are gradually separated to make the door body 2 movable relative to the cabinet 1.

In some specific examples, as illustrated in FIGS. 1 and 2, one of the two first snapping members is configured as a hook 41 while the other one thereof is configured as a protrusion 42. The protrusion 42 moves along with the slide rail 62, and the slide rail 62 is driven to move by the door body 2, such that when the protrusion 42 is snapped with the hook 41, the first snap assembly 4 functions to fix the door body 2 at the first position. When the door body 2 continues to move, the protrusion 42 is released from the hook 41, the first snap assembly 4 fails, and hence the door body 2 becomes movable relative to the cabinet 1.

Further, as illustrated in FIG. 2, an end of the slide rail support 61 facing the door body 2, i.e. a front end of the slide rail support 61, is provided with a recess 611 recessed backwards. A bottom wall of the recess 611 is provided with a protruding part 612 extending towards the door body 2 and spaced apart from two side walls 613 of the recess 611. That is, the protruding part 612 extends forwards from the bottom wall of the recess 611, and in an up-and-down direction, the protruding part 612 is located between the two side walls 613 and spaced apart from both of the side walls 613.

The protruding part 612 in conjunction with one of the two side walls 613 of the recess 611 forms the hook 41. As illustrated in FIG. 2, the protruding part 612 and an upper side wall 613 of the recess 611 form the hook 41, and the protruding part 612 and a lower side wall 613 of the recess 611 define a space to provide a clearance space for movement of the hook 41.

More specifically, as illustrated in FIG. 2, the protruding part 612 and the upper side wall 613 of the recess 611 define a U-shaped space with an opening facing forwards; the protruding part 612 and the lower side wall 613 of the recess 611 define a substantially Z-shaped space, including two horizontal segments and one connecting segment, in which the connecting segment is inclined forwards and downwards. Thus, the protruding part 612 moves more smoothly and does not interfere easily with the two side walls 613 of the recess 611.

Such a hook 41 has a simple structure and is easy to form, and the location of the hook 41 facilitates the operation of the hook 41. That is, since the hook 41 is located at the front end of the slide rail support 61, the hook 41 is easy to see when the door body 2 is opened. Thus, the process of operating the first snap assembly 4 is visualized, the operation accuracy is high, and the first snap assembly 4 is not easily damaged.

Further, in order to facilitate the operation of the hook 41, the hook 41 is provided with a pressing part 411 adapted to be pressed. In a specific example illustrated in FIG. 2, the pressing part 411 is configured as a cantilever formed on the protruding part 612 and extending forwards, and an upper surface of the cantilever is an operating surface adapted to be pressed. If it is intended to operate the first snap assembly 4 so as to disable the first snap assembly 4, it is necessary to press the operating surface, i.e. press down the pressing part 411 to separate the hook 41 from the protrusion 42.

Certainly, in other embodiments, the protruding part 612 and the lower side wall 613 of the recess 611 can form the hook 41. In such an embodiment, the protruding part 612 and the upper side wall 613 of the recess 611 defines the space that provided the clearance space for the movement of the hook 41. The pressing part 411 is configured as a cantilever formed on the protruding part 612 and extending forwards, and a lower surface of the cantilever is an operating surface adapted to be pressed. If it is intended to operate the first snap assembly 4 so as to disable the first snap assembly 4, it is necessary to press the operating surface, i.e. press the pressing part 411 upwards to separate the hook 41 from the protrusion 42.

In one embodiment, the operating surface is configured as a wavy surface to increase friction and facilitate operations of an operator. Certainly, the operating surface can be configured as a plane with a relatively high degree of roughness.

Further, as illustrated in FIG. 2, a middle part of the protruding part 612 is provided with a lightening hole 412, thereby ensuring the structural strength of the slide rail support 61 and reducing the weight of the slide rail support 61, in particular, reducing the weight of the hook 41, so as to further facilitate the movement and lightweight of the hook 41. In one embodiment, the lightening hole 412 can be one of a triangular hole, a circular hole and a square hole.

In one embodiment, the most front end of the protruding part 612 is provided with a guide surface 413, and the guide surface 413 is adapted to fit with the protrusion 42 to guide the protrusion 42 into or out of the hook 41. As illustrated in FIG. 2, in the embodiment where the protruding part 612 and the upper side wall 613 of the recess 611 form the hook 41, the guide surface 413 is formed at the most front end of an upper portion of the protruding part 612 and is inclined downwards from rear to front; in the embodiment where the protruding part 612 and the lower side wall 613 of the recess 611 form the hook 41, the guide surface 413 is formed at the most front end of a lower portion of the protruding part 612 and is inclined upwards from rear to front. In one embodiment, the guide surface 413 can be a bevel surface or a curved surface. When the guide surface 413 is the bevel surface, it is easier to manufacture; when the guide surface 413 is the curved surface, the transition is smoother and the guiding performance is better.

Figure 3:
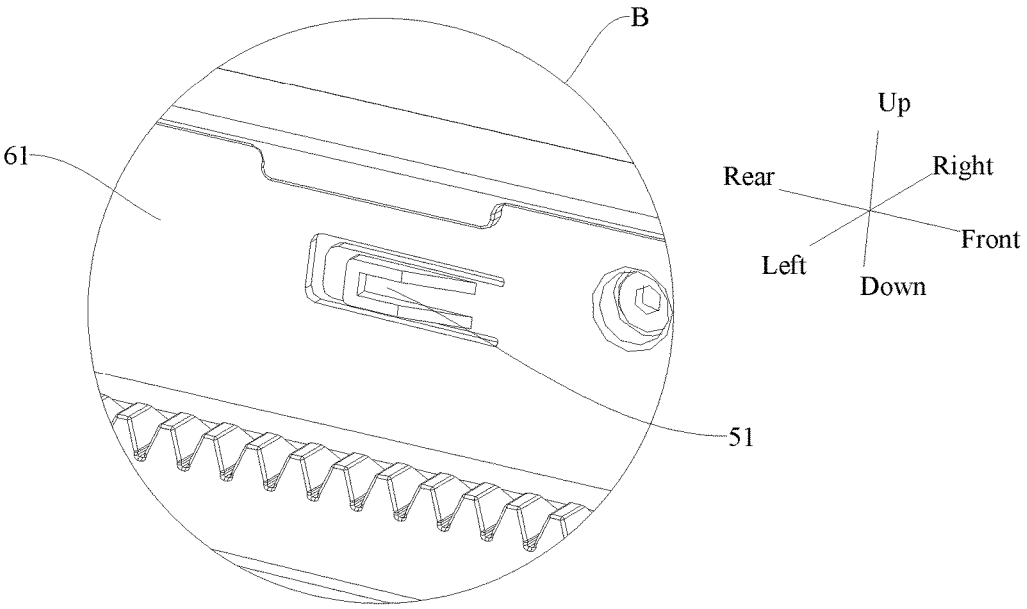
FIG. 3 is an enlarged view of part B in FIG. 1.

The second snap assembly 5 is configured to limit the door body 2 at the second position where the door body 2 is fixed to the cabinet 1. As illustrated in FIGS. 1 and 3, the second snap assembly 5 includes two second snapping members that are fitted with each other, and one of the two second snapping members is fixed to the slide rail support 61 while the other one thereof is fixed to the surface of the slide rail 62 facing the slide rail support 61. That is, the slide rail support 61 is fixed to the inner wall of the cabinet 1, the slide rail 62 is located at the inner side of the slide rail support 61, and the two second snapping members are arranged opposite to each other and fitted with each other. When the second snap assembly 5 functions, the two second snapping members are fitted to fix the door body 2 and the cabinet 1, i.e. fixing the door body 2 at the second position; when the second snap assembly 5 fails, the two second snapping members are gradually separated to make the door body 2 movable relative to the cabinet 1.

In some specific embodiments, as illustrated in FIG. 3, one of the two second snapping members is configured as a snap 51, and the other one thereof is configured as a slot 52. More specifically, the snap 51 is provided to a side surface of the slide rail support 61 opposite to the inner wall of the cabinet 1, and the snap 51 is configured as a cantilever having an end connected with the slide rail support 61. In one embodiment, the snap 51 and the slide rail support 61 are integrally formed by stamping, thereby making it easy to manufacture and low in production cost.

An inner surface of the snap 51 is provided with a pressing surface adapted to be pressed, and the pressing surface can be configured as a rough surface.

More specifically, as illustrated in FIG. 1, the slot 52 is configured as a rectangular hole defined in the slide rail 62, and as illustrated in FIG. 3, the snap 51 is configured as a cuboid snap 51 fitted with the rectangular hole.

It could be understood that the first snapping member and the second snapping member fixed to the slide rail support 61 are spaced apart along a front-and-rear direction, and the first snapping member is located in front of the second snapping member, i.e. the hook 41 is located in front of the snap 51; the first snapping member and the second snapping member fixed to the slide rail 62 are spaced apart along the front-and-rear direction, and the first snapping member is located in front of the second snapping member, i.e. the protrusion 42 is located in front of the slot 52.

In one embodiment, the hook 41 and the snap 51 each are formed with the slide rail support 61 integrally.

With reference to specific structures of the refrigeration apparatus 100 illustrated in FIGS. 1-12, the process of pulling the door body 2 out of the cabinet 1 will be described below in detail.

In general, the door body 2 sequentially passes through the closed position, the first position and the second position.

The door body 2 is pulled, and when the door body 2 is moved from the closed position to the first position, as illustrated in FIGS. 4 and 5, the protrusion 42 enters the hook 41 and is engaged with the hook 41 to fix the door body 2 and the cabinet 1, in which case goods can be taken out of or placed into the drawer 3.

The pressing part 411 of the hook 41 is pressed downwards from the outside of the cabinet 1 to disengage the protrusion 42 from the hook 41, and the door body 2 continues to be pulled, the protrusion 42 is gradually moved away from the hook 41, and as illustrated in FIG. 6, the drawer 3 can be taken out, which facilitates the cleaning of the drawer 3.

Figure 9:
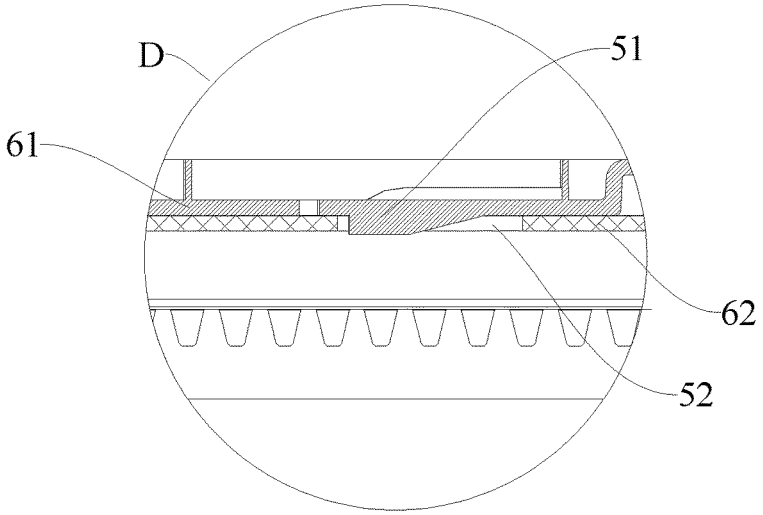
FIG. 9 is a partially enlarged view of part D in FIG. 8.

The door body 2 continues to be pulled to the second position, and as illustrated in FIGS. 7-9, the snap 51 is moved to a position where the snap 51 is fitted with the slot 52, so as to fix the door body 2 and the cabinet 1, in which case goods can be taken out of or placed into the drawer 3 if the drawer 3 is still there.

Figure 11:
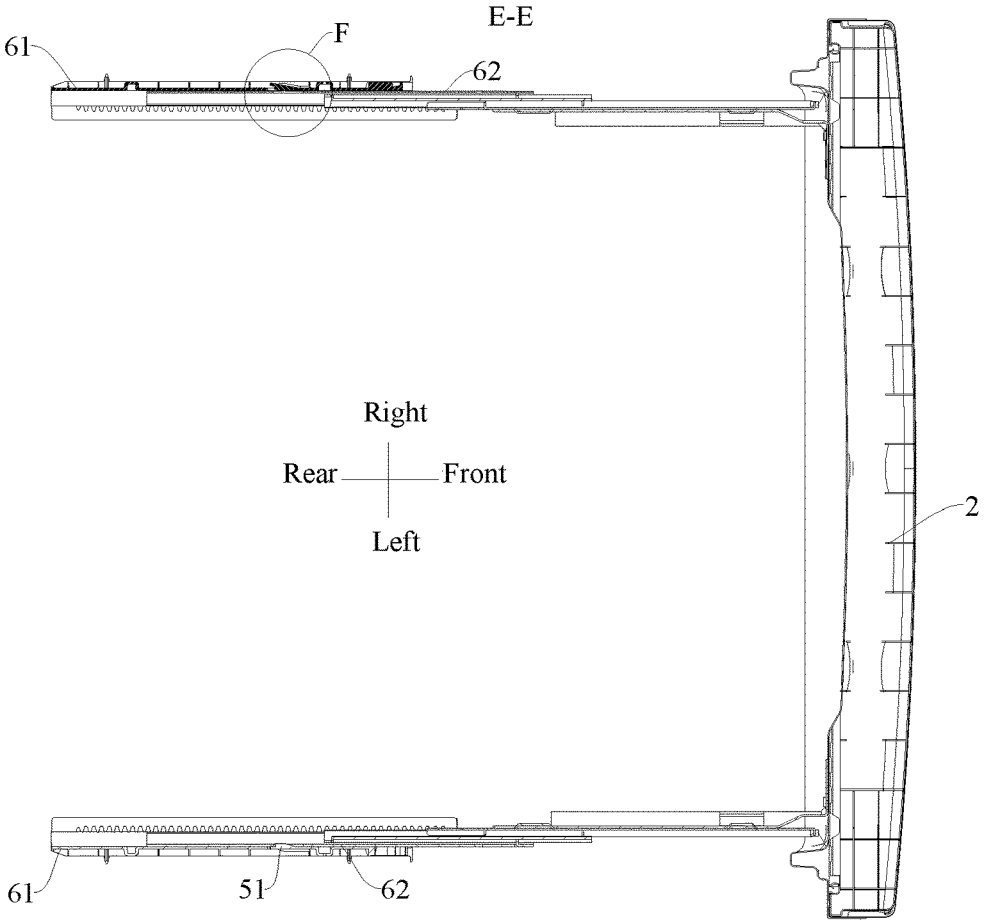
FIG. 11 is a sectional view of FIG. 10 along an E-E direction.
Figure 12:
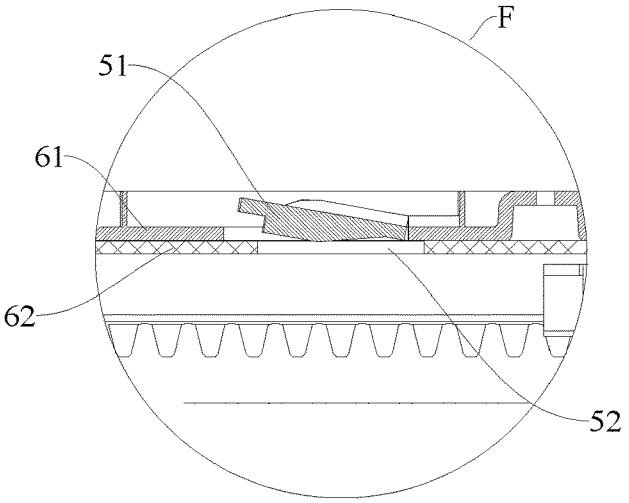
FIG. 12 is a partially enlarged view of part F in FIG. 11.

A user may stretch his hand into the cabinet 1, as illustrated in FIGS. 10-12, press the snap 51 outwardly to disengage the snap 51 from the slot 52, and then continue to pull the door body 2, such that the snap 51 is gradually moved away from the slot 52, the door body 2 can be wholly separated from the cabinet 1, and the slide rail 62 can be wholly separated from the slide rail support 61.

In short, for the refrigeration apparatus 100 according to embodiments of the present disclosure, the door body 2 is provided to the cabinet 1 in the drawable manner by means of the slide rail assembly 6, the drawer 3 is detachably provided to the door body 2, and two stages of snap assemblies are provided on a path between the slide rail support 61 and the slide rail 62, such that opening and closure of the door body 2, the removal of the drawer 3, the removal of the entire door body 2 can be realized easily. Furthermore, since the two stages of snap assemblies are provided and spaced apart, when the first snap assembly 4 fails or is damaged, the door body 2 may not come off the cabinet 1 directly due to a great force exerted by the user, thereby improving the safety, avoiding damage to the door body 2 and personnel, indirectly prolonging service life, and facilitating the cleaning of the drawer 3 and maintenance of the refrigeration apparatus 100.

In the specification, it is to be understood that terms such as "upper," "lower," "front," "rear,""left," "right," "inner," and "outer" should be construed to refer to the orientation as then described or as illustrated in the drawings under discussion for simplifying the description of the present disclosure, but do not alone indicate or imply that the device or element referred to may have a particular orientation or be constructed or operated in a particular orientation. Thus, these terms cannot be constructed to limit the present disclosure.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present disclosure, "a plurality of" means two or more than two, such as two, three, etc., unless specified otherwise.

In the present disclosure, unless specified or limited otherwise, the terms "mounted,""connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements or interactions of two elements.

Reference throughout this specification to "an embodiment," "some embodiments," "an example," "a specific example," or "some examples," means that a particular feature, structure, material, or characteristic described in connection with the embodiment or example is included in at least one embodiment or example of the present disclosure. Thus, the appearances of the phrases in various places throughout this specification are not necessarily referring to the same embodiment or example of the present disclosure. Furthermore, the particular features, structures, materials, or characteristics may be combined in any suitable manner in one or more embodiments or examples.

What is claimed is:

1. A refrigeration apparatus, comprising:

a cabinet;

a door body provided to the cabinet;

a drawer detachably provided to the door body;

a first snap assembly configured to limit the door body at a first position where the door body is fixed to the cabinet;

a second snap assembly configured to limit the door body at a second position where the door body is fixed to the cabinet;

wherein the door body passing through the first position and the second position sequentially in a process of pulling the door body out of the cabinet, the drawer configured to be pulled out of the door body when the first snap assembly fails, and the door body configured to be separated from the cabinet when the second snap assembly fails.

2. The refrigeration apparatus according to claim 1, further comprising:

a slide rail assembly comprising a slide rail support fixed to an inner wall of the cabinet; and a slide rail movably connected with the slide rail support and fixed to the door body.

3. The refrigeration apparatus according to claim 2, wherein the first snap assembly comprises two first snapping members that are fitted with each other, a first of the two first snapping members is fixed to the slide rail support, and a second of the two first snapping members is fixed to a surface of the slide rail facing the slide rail support.

4. The refrigeration apparatus according to claim 3, wherein the first of the two first snapping members is configured as a hook, and the second of the two first snapping members is configured as a protrusion.

5. The refrigeration apparatus according to claim 4, wherein an end of the slide rail support facing the door body is provided with a recess recessed backwards, a bottom of the recess is provided with a protruding part that extends towards the door body and is spaced apart from two side walls of the recess, and the protruding part and one side wall of the recess form the hook.

6. The refrigeration apparatus according to claim 5, wherein the hook is provided with a pressing part configured to be pressed.

7. The refrigeration apparatus according to claim 2, wherein the second snap assembly comprises two second snapping members that are fitted with each other, a first of the two second snapping members is fixed to the slide rail support, and a second of the two second snapping members is fixed to a surface of the slide rail facing the slide rail support.

8. The refrigeration apparatus according to claim 7, wherein the first of the two second snapping members is configured as a snap, and the second of the two second snapping members is configured as a slot.

9. The refrigeration apparatus according to claim 8, wherein the snap is provided to a side surface of the slide rail support opposite to the inner wall of the cabinet, and the snap is configured as a cantilever having an end connected with the slide rail support.

10. The refrigeration apparatus according to claim 1, wherein a part of the first snap assembly is configured provided at an edge of the cabinet adjacent to the door body, and is exposed when the door body is pulled out of the cabinet.

* * * * *